United States Patent [19]

Tarasewich et al.

[11] Patent Number: 4,862,952

[45] Date of Patent: Sep. 5, 1989

[54] FROST FREE HEAT EXCHANGER

[75] Inventors: Anthony Tarasewich, Glastonbury, Conn.; Fred J. Roberts, Agawam, Mass.; John L. Warner, Simsbury, Conn.

[73] Assignee: United Technologies Corporation, Hartford, Conn.

[21] Appl. No.: 191,460

[22] Filed: May 9, 1988

[51] Int. Cl.[4] ..... F24H 3/02

[52] U.S. Cl. ..... 165/54; 165/159; 165/166

[58] Field of Search ..... 165/54, 134.1, 166, 165/165, 159; 62/80, 402

[56] References Cited

U.S. PATENT DOCUMENTS

| | | | |
|---|---|---|---|
| 3,161,234 | 12/1964 | Rannenberg | 165/163 |
| 3,262,496 | 7/1966 | Bawabe | 165/166 |
| 4,301,863 | 11/1981 | Bizzarro | 165/166 |
| 4,344,481 | 8/1982 | Urie et al. | 165/166 |
| 4,579,163 | 4/1986 | Maendel | 165/54 |
| 4,623,019 | 11/1986 | Wiard | 165/166 |
| 4,645,001 | 2/1987 | Hillerstrom | 165/159 |
| 4,712,611 | 12/1987 | Witzel | 165/159 |

*Primary Examiner*—James C. Yeung

*Attorney, Agent, or Firm*—Llyod D. Doigan

[57] ABSTRACT

A plate fin heat exchanger is provided having: a core having a plurality of warm layers for conducting a warm fluid and a plurality of cold layers for conducting a cold fluid, the warm layers making a first pass parallel to at a front face of the exchanger, the front face being first exposed to the cold fluid, and then passing in an essentially counterflow pattern to the flow of the cold fluid through the exchanger from a back of the exchanger to near the front face thereof; and a baffle disposed at the back face of the heat exchanger, the baffle being adapted to create a high pressure profile at the front face such that the cold fluid is distributed upon the front face in such a manner that snow and ice build-up upon the front face is minimized.

16 Claims, 4 Drawing Sheets

FROST FREE HEAT EXCHANGER

TECHNICAL FIELD

This invention relates to a heat exchanger and more particularly to a plate fin heat exchanger capable of operation in extremely cold environments.

BACKGROUND ART

Plate fin heat exchangers generally consist of a core formed of a plurality of stacked layers. Each layer has a plurality of continuously corrugated or finned elements which are arranged to form a plurality of channels. The channels in one layer may lie in transverse or parallel relation to the channels formed in adjacent layers. A parting sheet separates the adjacent layers. Fluids having differing amounts of heat energy flow through the channels of adjacent layers so that heat energy may be transferred from fluid to fluid. Closure bars, which isolate the fluids, are generally mounted on the sides of each layer parallel to the channels therein. Top and bottom sheets and reinforcing bars may be required to structurally support the core. A typical heat exchanger construction is shown in U.S. Pat. No. 3,365,129 assigned to the assignee of this application.

Environmental control systems (ECSs), which utilize air cycle machines, are well known. Such systems generally control the temperature and humidity of air within an enclosed environment such as an aircraft cabin. An air cycle ECS generally includes; a compressor for pressurizing air input thereto, and a turbine for driving the compressor and for expanding and cooling the air. Some turbines are capable of delivering air at temperatures as low as 100° F. below zero. At such cold temperatures, moisture within the air is precipitated out in the form of snow or ice. The snow and ice may clog and shut down any downstream components, such as heat exchangers. If a heat exchanger becomes clogged, heat transfer among the fluids flowing therethrough may be severely reduced. The air from the turbine may not warm to useable levels for other downstream components The fluid, which warms the air from the turbine in the exchanger, may not be cooled enough for effective downstream use.

Prior art plate fin heat exchangers have difficulty in such extremely cold environments because of clogging due to ice and snow, and cold spots in the heat exchanger core. Accordingly, a plate fin heat exchanger for use in extremely cold environments is sought.

DISCLOSURE OF THE INVENTION

It is an object of the invention to provide a heat exchanger that is capable of operating continuously in extremely cold environments.

It is a further object of the invention to maximize the heat transfer rate between the air passing through the heat exchanger and a fluid being cooled while avoiding a snow/ice blockage of the the heat exchanger.

It is an object of the invention to prevent snow and ice from building up on a front face or within a heat exchanger.

According to the invention, a plate fin heat exchanger is provided having: a core having a plurality of warm layers for conducting a warm fluid and a plurality of cold layers for conducting a cold fluid, said warm layers making a first pass parallel to at a front face of the exchanger, the front face being first exposed to said cold fluid, and then passing in an essentially counterflow pattern to the flow of said cold fluid through the exchanger from a back face of the exchanger to near the front face thereof; and a baffle disposed at the back face of the heat exchanger, the baffle being adapted to create a high pressure area at the front face such that the cold fluid is distributed upon the front face in such a manner that snow and ice build-up upon the front face is minimized.

According to a feature of the invention, fins of the cold layers arranged upon the front face of the exchanger are recessed so that snow or ice impinges upon such fins between adjacent warm layers and so that the temperature of closure bars arranged upon the front face is maximized.

According to a further feature of the invention, the baffle limits the flow of the cold fluid through a central area of the core, to distribute flow of cold fluid across the front face of the core.

These and other objects, features and advantages of the present invention will become more apparent in light of the following detailed description of a best mode embodiment thereof, as illustrated in the accompanying drawing.

BEST MODE CARRYING OUT THE INVENTION

Figures 1, 2:
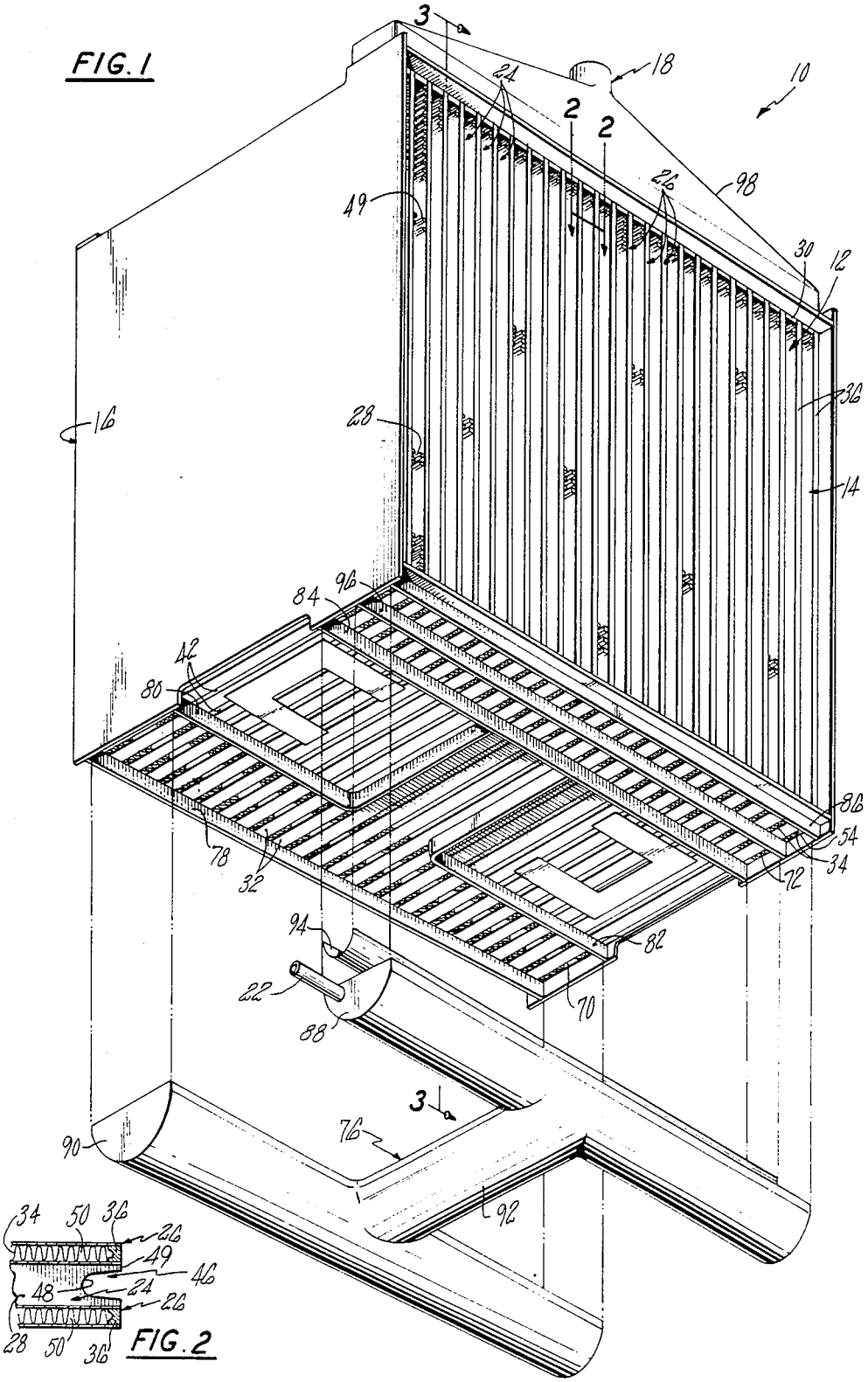
FIG. 1 is perspective, partially exploded view of the heat exchanger of the invention.
FIG. 2 is an expanded, sectional view of a front face of the heat exchanger taken along the line 2—2 of FIG. 1.

Referring to FIG. 1, a best mode embodiment of the plate fin heat exchanger 10 of the invention is shown. Such a heat exchanger would be typically used for exchanging heat energy between a relatively cold first fluid, such as air passing from the turbine of an air cycle machine (ACM, not shown), and a relatively warm second fluid. As one of ordinary skill in the art will readily appreciate, such a heat exchanger may be used for any purpose for which heat exchangers are used, and particularly where extremely cold environments may be encountered.

The heat exchanger 10 of the present invention has several portions including; a core 12 having a front face 14 and a back face 16, an inlet 18, a baffle 20 (see FIG. 5), and an outlet 22. Generally, a relatively cold first fluid is directed to the front face 14 of the core 12. The first fluid flows through the core and exits through the back face 16 of the core. The inlet 18 directs a relatively warm second fluid to the core and the outlet 22 directs the second fluid from the core.

The core 12 has twenty-five cold layers 24 through which the relatively cold first fluid flows, interspersed among twenty-six warm layers 26 through which the relatively warm second fluid flows. Each cold layer has a plurality of ruffled fins 28 arranged parallel to the flow of the cold air through the core, a top closure bar 30 (see FIG. 4 which shows a top view of the core), and bottom closure bar 32.

Figure 3:
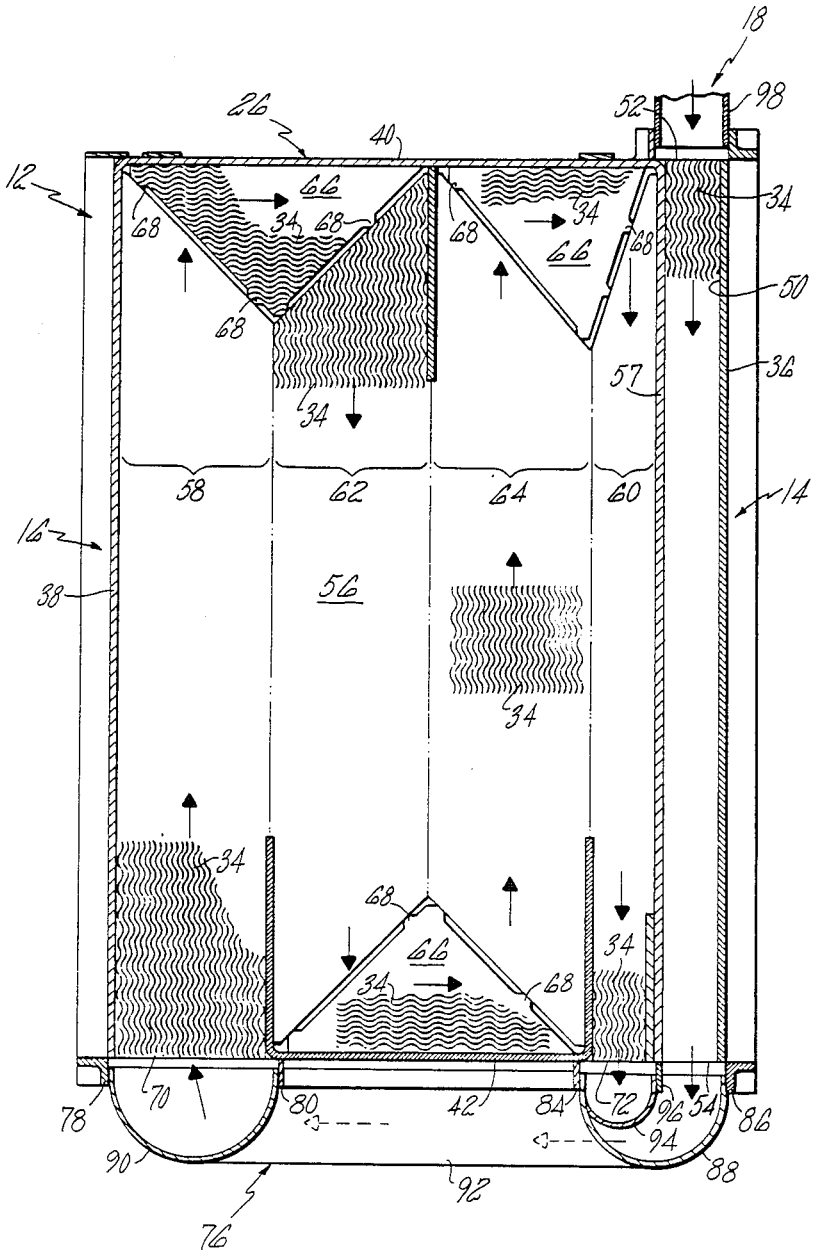
FIG. 3 is a side view of the heat exchanger taken along the line 3—3 of FIG. 1.

Referring to FIGS. 1 and 3, each warm layer 26 has a plurality of ruffled fins 34 arranged in parallel to the direction of the second fluid flow. The fins of each warm layer are more dense than the fins within each cold layer to promote the transfer of heat energy from the warm layers to the cold layers as is known in the art. Each layer also has a front closure bar 36 and a back closure bar 38. As will be discussed infra, the warm layers also have top closure bars 40 (see also FIG. 4) and bottom closure bars 42.

Referring to FIG. 2, an expanded, sectional view of a portion of the front face 14 of the core is shown. A fin 28 of a cold layer 24 is bounded on either side by a warm layer 26. Each warm layer is sealed by a closure bar 36. The fin has a cut-out portion 46 which has a semi-circular end portion 48 and two legs 49 which diverge outwardly from the end portion 48 toward the front face of the core.

Referring to FIG. 3, a flow pattern of the second fluid through each warm layer 26 is shown. A finned first channel 50, which has a top portion 52 and a bottom portion 54, is arranged adjacent to the front face 14 of the core 12 and perpendicularly to the fins 28 of each cold layer 24. The front closure bar 36 seals the first channel 50 from the front face of the core. The first channel is open at its top portion and at its bottom portion for the ingress and egress of the second fluid, respectively, as will be discussed infra. A finned second channel 56 is M-shaped and basically directs the second fluid through the core in counterflow to the direction of the flow of the first fluid through the core. The first and second channels are separated by a closure bar 57.

The second channel 56 has four legs, an outer first leg 58, an outer second leg 60 (the outer legs being parallel to each other), an inner first leg 62, and an inner second leg 64 (each of the inner legs being angled toward each other and toward an adjacent outer leg). Each inner and outer leg, and the two inner legs are joined by triangular sections 66 to effectuate a turn of the fluid flow through the second channel as will be discussed infra. The triangular sections are spaced from the legs by tabs 68 so that the ruffled fins 34 of the legs and the triangular sections need not be exactly aligned with each other. Closure bars 40 (see also FIG. 4) seal the second channel from top of the the outer first leg to the top of the outer second leg. Closure bars 42 seal the bottom of the second channel where the inner first and second legs are joined by the triangular section. The back closure bar 38 seals the outer first leg from the back face 16 of the core 12. The second channel is open at a bottom portion 70 of the outer first leg and a bottom portion 72 of the outer second leg for the ingress and egress of the second fluid as will be discussed infra.

An H-shaped first manifold 76 is sealingly appended to core support bars 78, 80, 84, 82, and 86 by conventional means. The first manifold is comprised of a first conduit 88 and a second conduit 90 connected by a cross-member 92. The conduits and the cross-member each have a semicircular cross-section (see FIG. 3). A roughly half-circular second manifold 94 is disposed coaxially within the first conduit 88 at the bottom of the outer second leg 60. The outlet 22 extends from the second manifold 94 through the first conduit 88 to direct the second fluid from the exchanger as will be discussed infra. The second manifold is sealingly appended to support bars 84, 96 at the bottom of the core by conventional means.

Figure 4:
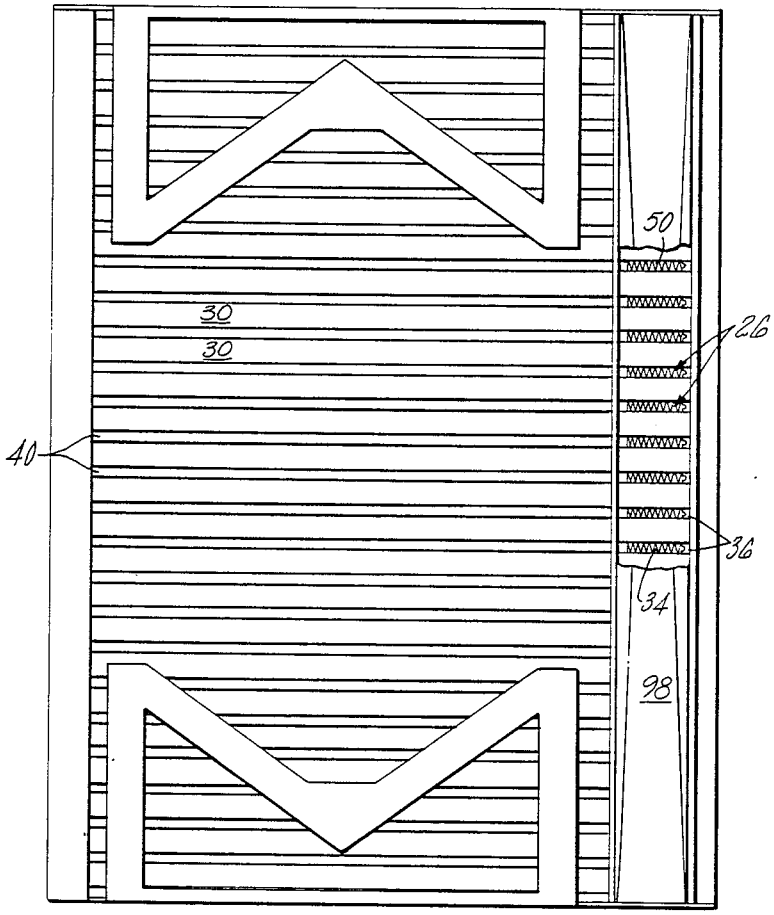
FIG. 4 is a top view of the heat exchanger of FIG. 1.

Referring to FIGS. 1, 3, and 4, a third manifold 98 is disposed upon the top portion 52 of the first channel 50. The inlet 18 directs the second fluid to the third manifold 98 for distribution within the warm layers 26.

Figure 5:
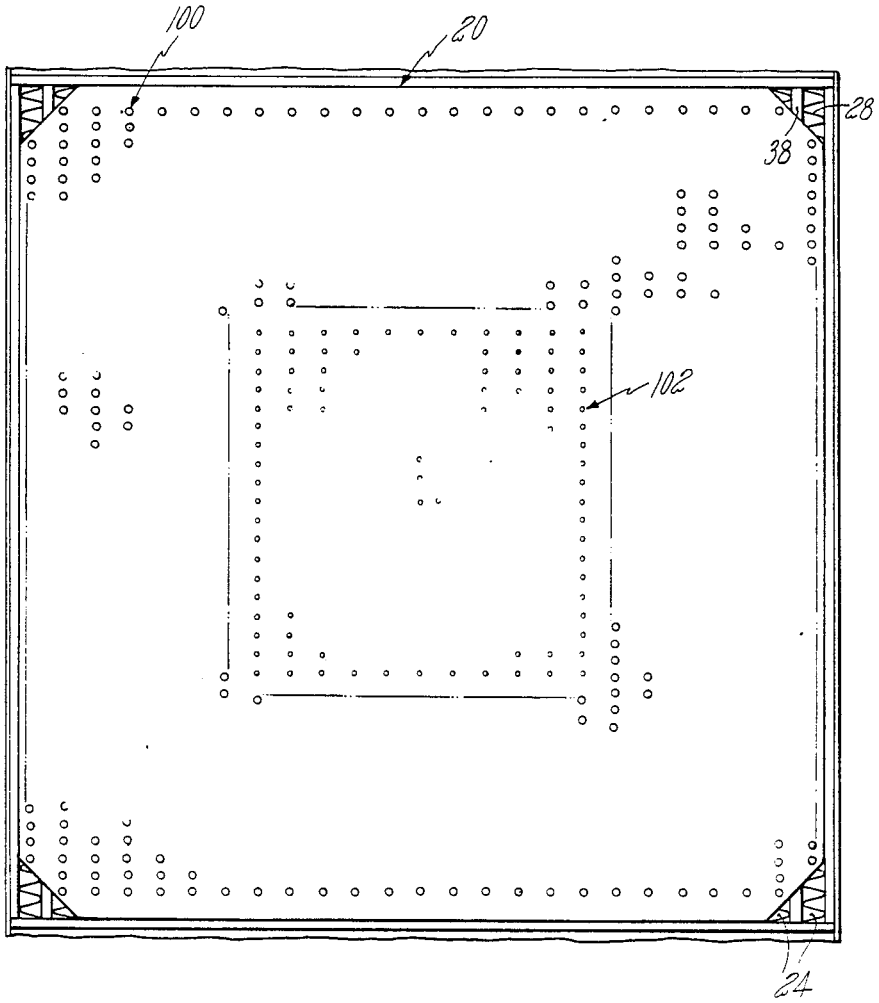
FIG. 5 is a view of the back face of the heat exchanger of FIG. 1.

Referring to FIG. 5, the baffle 20 is shown. The baffle is attached by conventional means to the back face 16 of the core. An array of holes 100 are drilled through the baffle A central array 102 of holes essentially form a square within the array 100. The holes with in the central array have a smaller diameter than the other holes in the array. In the preferred embodiment, the holes in the central array have a diameter of about $0.078 \pm 0.004$ inches, and the other holes have a diameter of about $0.109 \pm 0.004$ inches. Each hole aligns with a channel of a cold layer 24 to allow the first fluid to flow therethrough.

In operation, air (i.e. the first fluid) exits from the ACM turbine (not shown) at temperatures as low as minus 100° F. but typically minus 70° to 75° F. As stated supra, upon expansion of the first fluid by the turbine, the moisture within the air precipitates out as ice and snow. The snow, ice and extremely cold air are directed to the front face 14 of the core by ducting (not shown) The first fluid passes through the fins 28 of the cold layers at a rate of about 90 pounds per minute. The core is designed to raise the temperature of the first fluid to about 47° F.

In order to melt the snow and ice impinging on the front face 14 and within the core and to warm the first fluid, the relatively warm second fluid (about 93° F.) is pumped through the inlet 18 into the third manifold 98 for distribution through the first channels 50 of the warm layers 26. The second fluid, which is a solution of at least 65% by weight ethylene glycol, is pumped at a rate of about 85 pounds per minute. The second fluid serves to continuously melt the snow and ice accumulating on the front face and within the core.

The cut-out portions 46 of the fin 28 on the front face of the core serve two purposes. First, by removing fin material to create the cut-out 46, the ability of the fin to wick away the heat energy of the closure bars is reduced. The closure bars are kept warmer thereby which increases their ability to melt snow and ice that impinges thereon. Second, by causing snow and ice to impinge upon the fins 24 between adjacent warm layers, melting is enhanced.

The second fluid passes into the first conduit 88 of the first manifold 76 where it is directed through the cross-member 92 to the second conduit 90. From the second conduit, the second fluid passes through the second channel 56. The fluid passes into the bottom portion 70 of the outer first leg 58, and through the outer first leg 58, the inner first leg 62, the inner second leg 64, and the outer second leg 60 in essentially a counterflow pattern to the flow of the first fluid through the cold layers 24. After passing from the bottom portion 72 of the outer second leg, the second fluid is collected by the second manifold 94 and directed for use downstream of the exchanger through the outlet 22.

By providing the first channel 50 with the second fluid before the second fluid is cooled by the first fluid, clogging of the front face 14 of the core 12 is minimized. By then moving the second fluid through the essentially counterflow second channel 56, the mean temperature difference (and the heat transfer rate) between the first fluid and the second fluid is maximized thereby allowing for the efficient transfer of heat energy between the two fluids The probability of ice and snow build-up on the front face of the core, cold spots within the core, and the refreezing of melted ice and snow within the core are reduced.

After passing through the core, the first fluid flows through the baffle 20. Because the first fluid assumes a roughly parabolic velocity profile while being directed to the front face of the core, the first fluid (and the snow and ice carried thereby) tends to flow through a central area of the core. As such, snow and ice tend to build up on a central area of the front face of the core which may cause clogging Also, the cold first fluid passing through a relatively small central volume of the core tends to cause cold spots within the core. Cold spots may hamper the cores ability to efficiently transfer heat. Because the holes in the central array 102 are smaller than the rest of the holes in the array 100, a relatively high pressure region is built up in an area corresponding to the central array within the core and at the front face 14 thereof. The high pressure area causes the first fluid, and the snow and ice carried thereby, to be distributed across the front face of the core thereby preventing ice and snow build-up. The distribution of the flow of air through the core caused by the baffle also helps minimize cold spots within the core.

Although the invention has been shown and described with reference to a best mode embodiment thereof, it should be understood by those skilled in the art that the foregoing and various other changes, omissions and additions in the form and detail thereof may be made therein without departing from the spirit and scope of the invention.

What is claimed:

1. A plate fin heat exchanger for use in an extremely cold environment for exchanging heat energy between a relatively warm fluid and an extremely cold fluid, said exchanger having a core, said core having a plurality of finned warm layers for conducting said warm fluid therethrough interspersed among a plurality of finned cold layers for conducting said cold fluid therethrough, a front face being first exposed to said cold fluid, and a back face, said exchanger characterized by:

said warm layers having a first channel arranged adjacent to and parallel to said front face of said core, and a second channel arranged in a counterflow pattern to the flow of said cold fluid through said core; and, a baffle disposed at the back face of the heat exchanger, the baffle being adapted to create a high pressure profile at said front face such that said cold fluid is distributed within said core and upon said front face in such that snow and ice build-up upon the front face and cold spots within said core are minimized.

2. The heat exchanger of claim 1 further characterized by:

a portion of said fins of said cold layers being recessed from said front face such that build-up of snow or ice upon said front face is minimized.

3. The heat exchanger of claim 1 wherein said baffle is further characterized by:

a first array of openings, each opening of said first array passing an amount of said cold fluid therethrough, and a second array of openings for passing said cold fluid therethrough, each opening of said second array passing a lesser portion of said cold fluid than each said opening of said first array, said second array being disposed within said first array, said second array creating a relatively high pressure area corresponding to said disposition of said second array within said core and upon said front face.

4. The heat exchanger of claim 3 further characterized by:

a portion of said fins of said cold layers being recessed from said front face such that build-up of snow or ice upon said front face is minimized.

5. The heat exchanger of claim 1 wherein said second channel is further characterized by:

an M-shaped cross-section.

6. A plate fin heat exchanger for exchanging heat energy between a relatively warm fluid and a relatively cold fluid, said exchanger having a core, said core having a plurality of finned warm layers for conducting said warm fluid therethrough interspersed among a plurality of finned cold layers for conducting said cold fluid therethrough, a front face being first exposed to said cold fluid, and a back face, said exchanger characterized by:

said warm layers having a first channel arranged adjacent to and parallel to said front face of said core, and a second channel arranged in a counterflow pattern to the flow of said cold fluid through said core; and, a baffle disposed at the back face of the heat exchanger, the baffle being adapted to create a high pressure profile at said front face such that said cold fluid is distributed within said core and upon said front face in such that snow and ice build-up upon the front face in and cold spots within said core are minimized.

7. The heat exchanger of claim 6 further characterized by:

a portion of said fins of said cold layers being recessed from said front face such that build-up of snow or ice upon said front face is minimized.

8. The heat exchanger of claim 6 wherein said baffle is further characterized by:

a first array of openings, each opening of said first array passing an amount of said cold fluid therethrough, and a second array of openings for passing said cold fluid therethrough, each opening of said second array passing a lesser portion of said cold fluid than each said opening of said first array, said second array being disposed within said first array, said second array creating a relatively high pressure area corresponding to said disposition of said second array within said core and upon said front face.

9. The heat exchanger of claim 8 further characterized by:

a portion of said fins of said cold layers being recessed from said front face such that build-up of snow or ice upon said front face is minimized.

10. The heat exchanger of claim 6 wherein said second channel is further characterized by:

an M-shaped cross-section.

11. The heat exchanger of claim 10 further characterized by:

a portion of said fins of said cold layers being recessed from said front face such that build-up of snow or ice upon said front face is minimized.

12. The heat exchanger of claim 10 wherein said baffle is further characterized by:

a first array of openings, each opening of said first array passing an amount of said cold fluid therethrough, and a second array of openings for passing said cold fluid therethrough, each opening of said second array passing a lesser portion of said cold fluid than each said opening of said first array, said second array being disposed within said first array, said second array creating a relatively high pressure area corresponding to said disposition of said second array within said core and upon said front face.

13. The heat exchanger of claim 12 further characterized by:

a portion of said fins of said cold layers being recessed from said front face such that build-up of snow or ice upon said front face is minimized.

14. A plate fin heat exchanger for use in an extremely cold environment for exchanging heat energy between a relatively warm fluid and an extremely cold fluid, said exchanger having a core, said core having a plurality of finned warm layers for conducting said warm fluid therethrough interspersed among a plurality of finned cold layers for conducting said cold fluid therethrough, a front face being first exposed to said cold fluid and a back face, said exchanger characterized by;

said warm layers having a first channel means for warming said front face, said first channel means being arranged adjacent to and perpendicularly to said front face of said core, and a second channel means for maximizing the mean temperature difference between the temperature of the relatively warm fluid and the extremely cold fluid is maximized, said second channel means being arranged in a counterflow pattern to the flow of said cold fluid through said core; and, a baffle disposed at the back face of the heat exchanger, the baffle being adapted to create a high pressure area at said front face such that said cold fluid is distributed within said core and upon said front face such that snow and ice build up on the front face and cold spots within said core are minimized.

15. A plate fin heat exchanger for exchanging heat energy between a relatively warm fluid and a relatively cold fluid said exchanger having a core, said core having a plurality of thinned warmed layers for conducting said warm fluid therethrough and disbursed among the plurality of finned cold layers for conducting said cold fluid therethrough, a front face being first exposed to said cold fluid, and a back face, said exchanger characterized by:

said warm layers having a first channel means for warming said front face, said first channel means being arranged adjacent to and perpendicularly to said front face of said core, and a second channel means for maximizing the mean temperature difference between the temperature of the relatively warm fluid and the extremely cold fluid is maximized, said second channel means being arranged in a counterflow pattern t the flow of said cold fluid through said core; and, a baffle disposed at the back face of the heat exchanger, the baffle being adapted to create a high pressure area at said front face such that said cold fluid is distributed within said core and upon said front face such that snow and ice build up on the front face and cold spots within said core are minimized.

16. A heat exchanger for exchanging heat energy between a relatively warm fluid and a relatively cold fluid, said exchanger having a core, said core having a plurality of warm layers for conducting said warm fluid therethrough and disbursed among a plurality of cold layers for conducting said fluid therethrough, a front face being first exposed to said cold fluid, and a back face, said exchanger characterized by:

said warm layers having a first channel means for warming said front face, said first channel means being arranged adjacent to and perpendicularly to said front face of said core, and a second channel means for maximizing the mean temperature difference between the temperature of the relatively warm fluid and the extremely cold fluid is maximized, said second channel means being arranged in a counterflow pattern to the flow of said cold fluid through said core; and, a baffle disposed at the back face of the heat exchanger, the baffle being adapted to create a high pressure area at said front face such that said cold fluid is distributed within said core and upon said front face such that snow and ice build up on the front face and cold spots within said core are minimized.

* * * * *

UNITED STATES PATENT AND TRADEMARK OFFICE

CERTIFICATE OF CORRECTION

PATENT NO. : 4,862,952

DATED : September 5, 1989

INVENTOR(S) : Anthony Tarasewich, Fred J. Roberts and John L. Warner

It is certified that error appears in the above-identified patent and that said Letters Patent is hereby corrected as shown below:

Column 5, Claim 1, line 50, after "face" delete "in".

Column 6, Claim 6, line 30, after "face" delete "in".

Column 6, Claim 6, line 31, after "face" delete "in".

Column 8, Claim 15, line 12, "t" should read --to--.

Signed and Sealed this

Twenty-second Day of January, 1991

*Attest:*

HARRY F. MANBECK, JR.

*Attesting Officer*

*Commissioner of Patents and Trademarks*